US007017894B1

(12) United States Patent
Lin

(10) Patent No.: US 7,017,894 B1
(45) Date of Patent: Mar. 28, 2006

(54) VISE CLAMP

(76) Inventor: Chian Ling Lin, 6F,-10, No. 138, Sec. 1, Lyushun Rd., Beitun District, Taichung City (TW) 406

( * ) Notice: Subject to any disclaimer, the term of this patent is extended or adjusted under 35 U.S.C. 154(b) by 0 days.

(21) Appl. No.: 11/202,000

(22) Filed: Aug. 11, 2005

(51) Int. Cl.
*B25B 5/02* (2006.01)

(52) U.S. Cl. ..... 269/6; 269/3; 269/171.5

(58) Field of Classification Search ..... 269/6, 269/3, 166–171.5, 228, 203, 197–199; 81/487
See application file for complete search history.

(56) References Cited

U.S. PATENT DOCUMENTS 5,666,964 A * 9/1997 Meilus ..... 600/557
6,386,530 B1 * 5/2002 Marks ..... 269/6
6,450,489 B1 * 9/2002 Wang ..... 269/6
6,575,442 B1 * 6/2003 Klimach et al. ..... 269/6
6,585,243 B1 * 7/2003 Li ..... 269/6

* cited by examiner

*Primary Examiner*—Lee D. Wilson
(74) *Attorney, Agent, or Firm*—Charles E. Baxley

(57) ABSTRACT

There is disclosed a vise clamp for a stable and precise operation. The vise clamp includes movable and stationary jaws including corresponding contact portions. The movable jaw is secured to an end of a rod. The rod is inserted through the stationary jaw in a sliding manner. A first trigger is connected to the bottom of the stationary jaw. A second trigger is connected to a handle extended from the bottom of the stationary jaw. The first trigger is operable to drive a moving device in the stationary jaw. The second trigger is operable to drive a retaining device in the stationary jaw. The retaining device consists of grip collars around the rod. The moving device includes grip collars around the rod and two linings between the grip collars and the rod. Thus, the area of the contact of the moving device with the rod is large. Hence, the operation of the vise clamp is stable and precise, and the clamping force of the vise clamp is large.

9 Claims, 6 Drawing Sheets

VISE CLAMP

BACKGROUND OF INVENTION

1. Field of Invention

The present invention relates to a vise clamp and, more particularly, to a vise clamp that can be pushed in order to clamp, and the area of the contact of a movable jaw with a guide is increased in order to promote the stability and precision in its operation and its clamping force.

2. Related Prior Art

A vise clamp is primarily used in places where a vise cannot be used. For example, in processing planks, a vise clamp can be moved to various positions as desired by a user, but a vise cannot. A C-shaped vise clamp includes a body, a stationary jaw formed on the body, a screw installed on the body, and a movable jaw with a screw hole for receiving the screw. By means of rotating the screw, the movable jaw is moved up and down in order to clamp. For not including a retaining device, the C-shaped vise clamp often looses when subject to vibration. The following steps of the operation are thus affected. Moreover, the movable jaw can only be moved by means of rotating the screw, the speed of clamping is slowed. The smoothness of the operation is affected.

There has been devised a vise clamp including a stationary jaw and a movable jaw. The movable jaw is secured to an end of a rod inserted through the stationary jaw. In the stationary jaw are put a moving device for moving the rod and a retaining device for retaining the rod. The moving device is driven by means of a first trigger connected to the stationary jaw. The retaining device is driven by means of a second trigger connected to the stationary jaw. As a user operates the first trigger, the moving device moves the rod backwards in order move the contact portion of the movable jaw towards the contact portion of the stationary jaw for clamping. As the user operates the second trigger, the retaining device releases the rod so that the rod can be moved. Hence, the movable jaw can be released and retained quickly. The clamping operation is convenient. The time required for an effective clamping operation is short. The moving device includes grip collars for gripping and moving the rod. However, each grip collar contacts the rod at a limited spot. Hence, the grip collars often make cuts in the rod. Such cuts affect the grip of the rod by the grip collars. Moreover, such cuts reduce the strength of the rod. The limited spots provide inadequate grip so that the rod moves relative to the moving device when a large force is exerted on the first trigger for clamping. Therefore, the performance of this conventional vise clamp is not satisfactory.

The present invention is therefore intended to obviate or at least alleviate the problems encountered in prior art.

SUMMARY OF INVENTION

The primary objective of the present invention is to provide a stable and precise vise clamp.

According to the present invention, a vise clamp includes a stationary jaw, a rod inserted through the stationary jaw, and a movable jaw secured to the rod. A moving device is put in the stationary jaw. The moving device includes a plurality of grip collars around the rod, two linings between the grip collars and the rod, and a spring for pushing the grip collars so that the grip collars are perpendicular to the rod in order to release the rod. A first trigger is connected to the stationary jaw and operable to tilt the grips collars relative to the rod. A retaining device is put in the stationary jaw. The retaining device includes a first grip collar around the rod, a second grip collar put around the rod and formed with a hunch for abutment against the first grip collar, a third grip collar around the rod, a spring for pushing the first grip collar, and a lever extended from the third grip collar. The first and third grip collars are normally tilted relative to the rod in order to grip the rod. A second trigger is connected to the stationary jaw and operable to push the third grip collar through the lever so that the third and first grip collars are perpendicular to the rod.

Other advantages and novel features of the invention will become more apparent from the following detailed description in conjunction with the drawings.

BRIEF DESCRIPTION OF DRAWINGS

The present invention will be described through detailed illustration of the preferred embodiment referring to the drawings.

DETAILED DESCRIPTION OF PREFERRED EMBODIMENT

Figure 1:
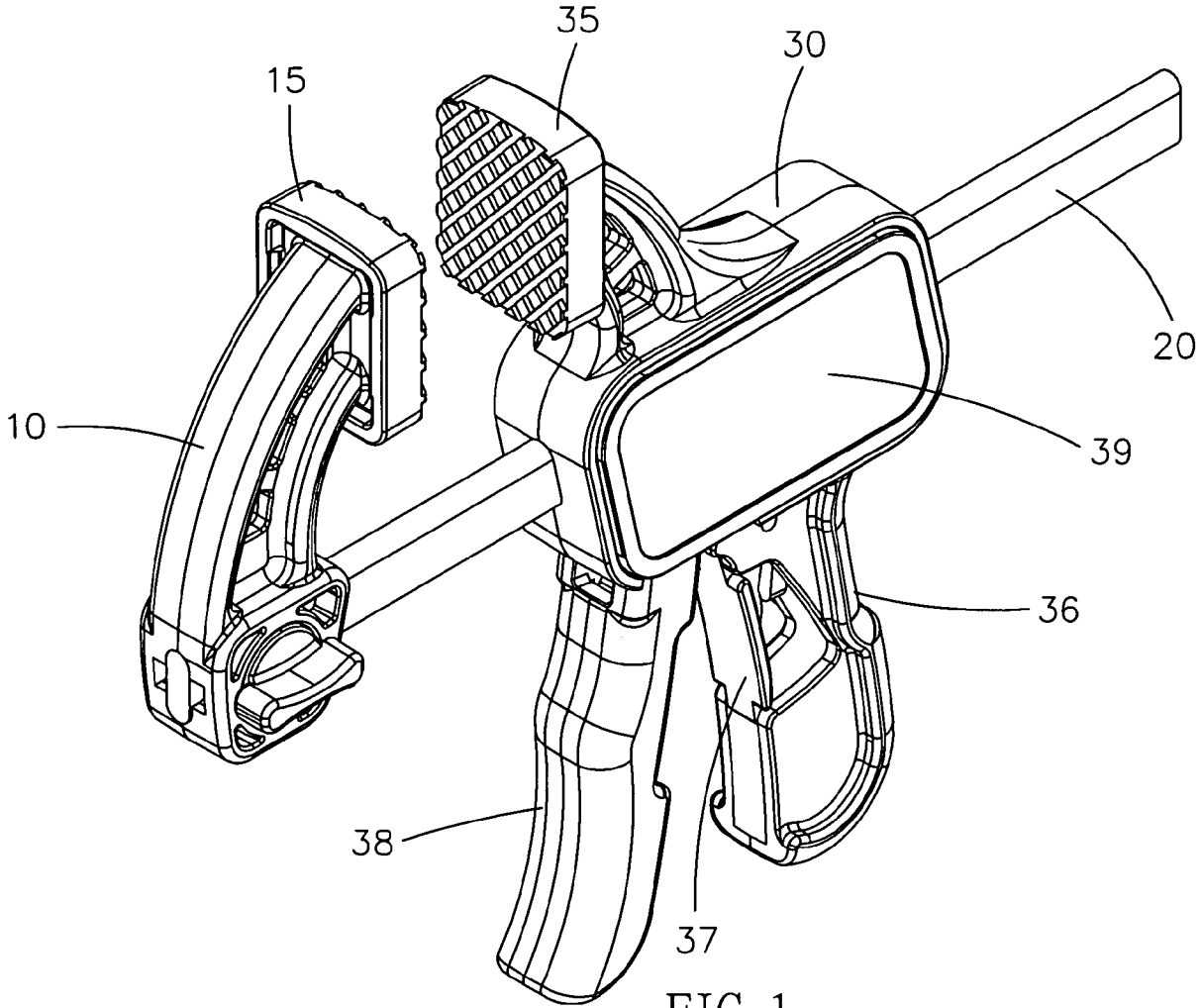
FIG. 1 is a perspective view of a vise clamp according to the preferred embodiment of the present invention.
Figure 2:
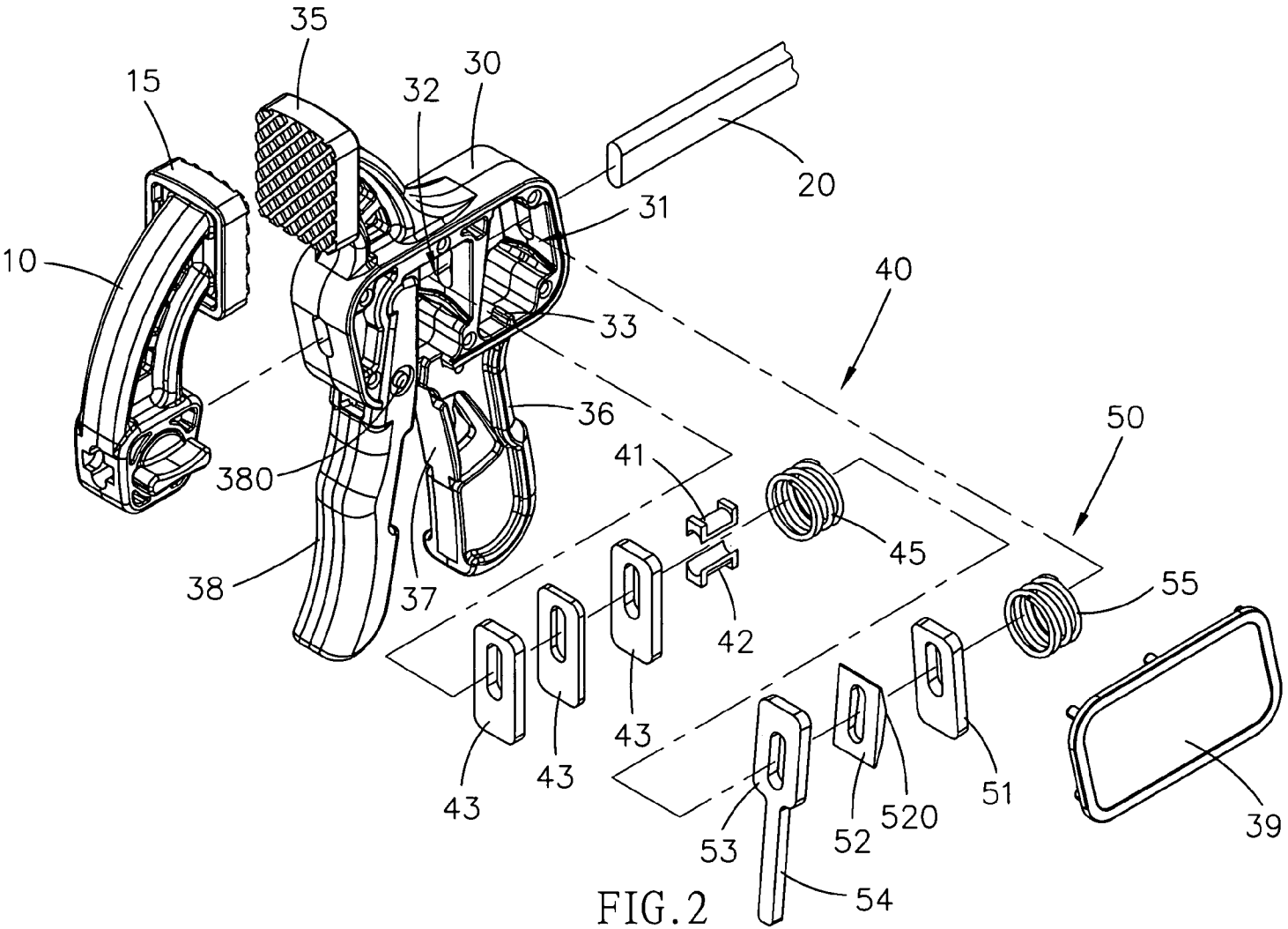
FIG. 2 is an exploded view of the vise clamp shown in FIG. 1.
Figure 3:
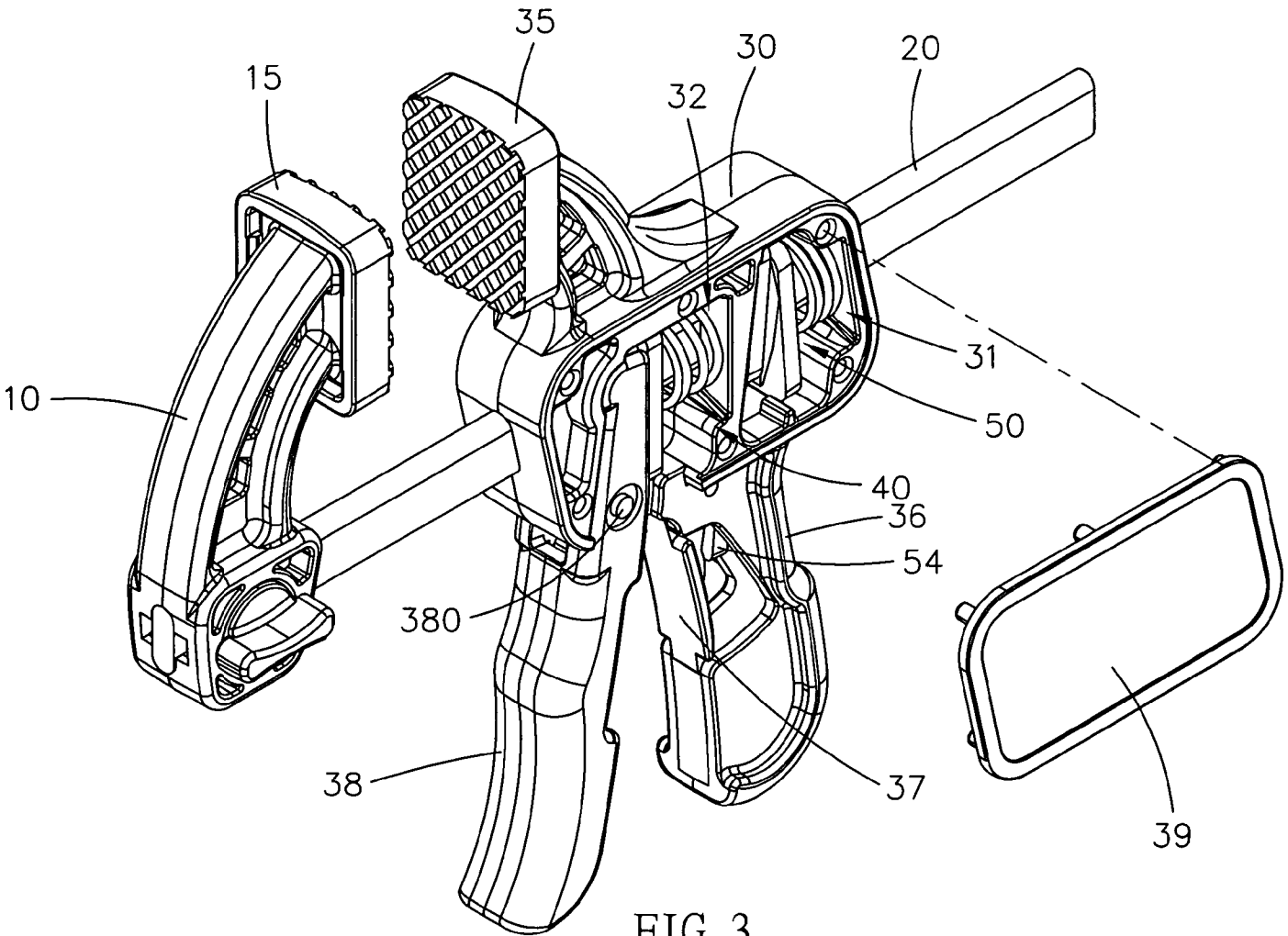
FIG. 3 is similar to FIG. 1 but shows some elements that are normally concealed by means of a cover.

Referring to FIGS. 1 and 2, there is shown a vise clamp according to the preferred embodiment of the present invention. The vise clamp includes a movable jaw 10, a rod 20 and a stationary jaw 30. The movable jaw 10 includes a contact portion 15. The movable jaw 10 is secured to an end of the rod 20. The rod 20 is inserted through the stationary jaw 30 in which a moving device 40 and a retaining device 50 are installed. The stationary jaw 30 includes a contact portion 35 corresponding to the contact portion 15 of the movable jaw 10. The rod 20 can be moved relative to the stationary jaw 30 so that the contact portion 15 of the movable jaw 10 can be moved towards the contact portion 15 of the movable jaw 10 for clamping a workpiece and that the contact portion 15 of the movable jaw 10 can be moved from the contact portion 15 of the movable jaw 10 for releasing the workpiece.

Referring to FIGS. 1 through 4, the stationary jaw 30 defines a first chamber 31 in a rear portion in order to contain the retaining device 50 and a second chamber 32 in a middle portion in order to contain the moving device 40. A lower block 33 is formed on the floor of the first chamber 31. An upper block 330 is formed on the ceiling of the first chamber 31. A handle 36 is extended from the stationary jaw 30 substantially below the first chamber 31. A second trigger 37 is connected to the stationary jaw 30 in front of the handle 36 in order to drive the retaining device 50. A first trigger 38 is connected to the stationary jaw 30 in front of the second trigger 37. On the second trigger 37 is installed a bar 380 for driving the moving device 40. A cover 39 is secured to the stationary jaw 30 in order to cover the first chamber 31 and the second chamber 32.

Figure 4:
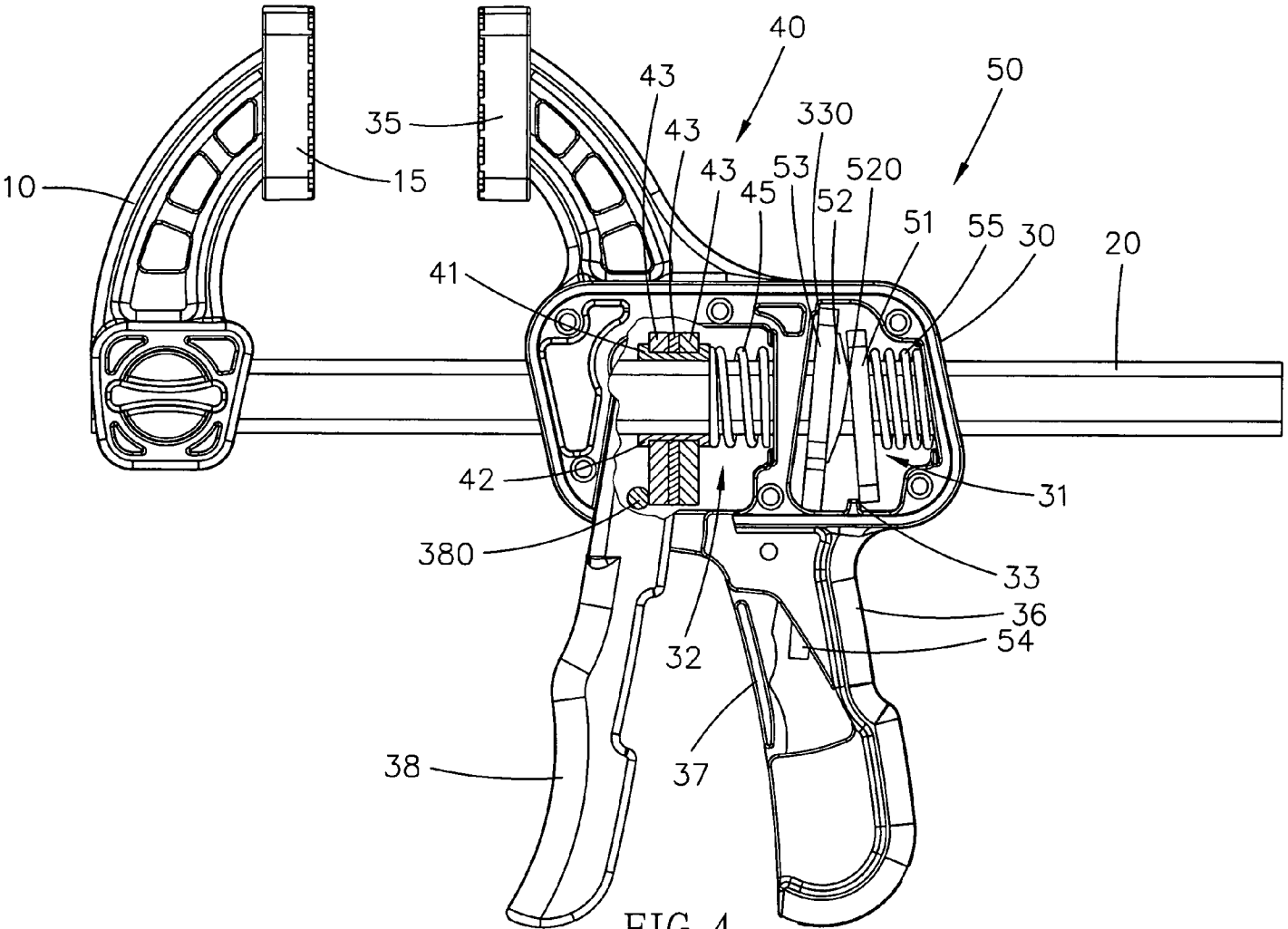
FIG. 4 is a side view of the vise clamp shown in FIG. 3.
Figure 5:
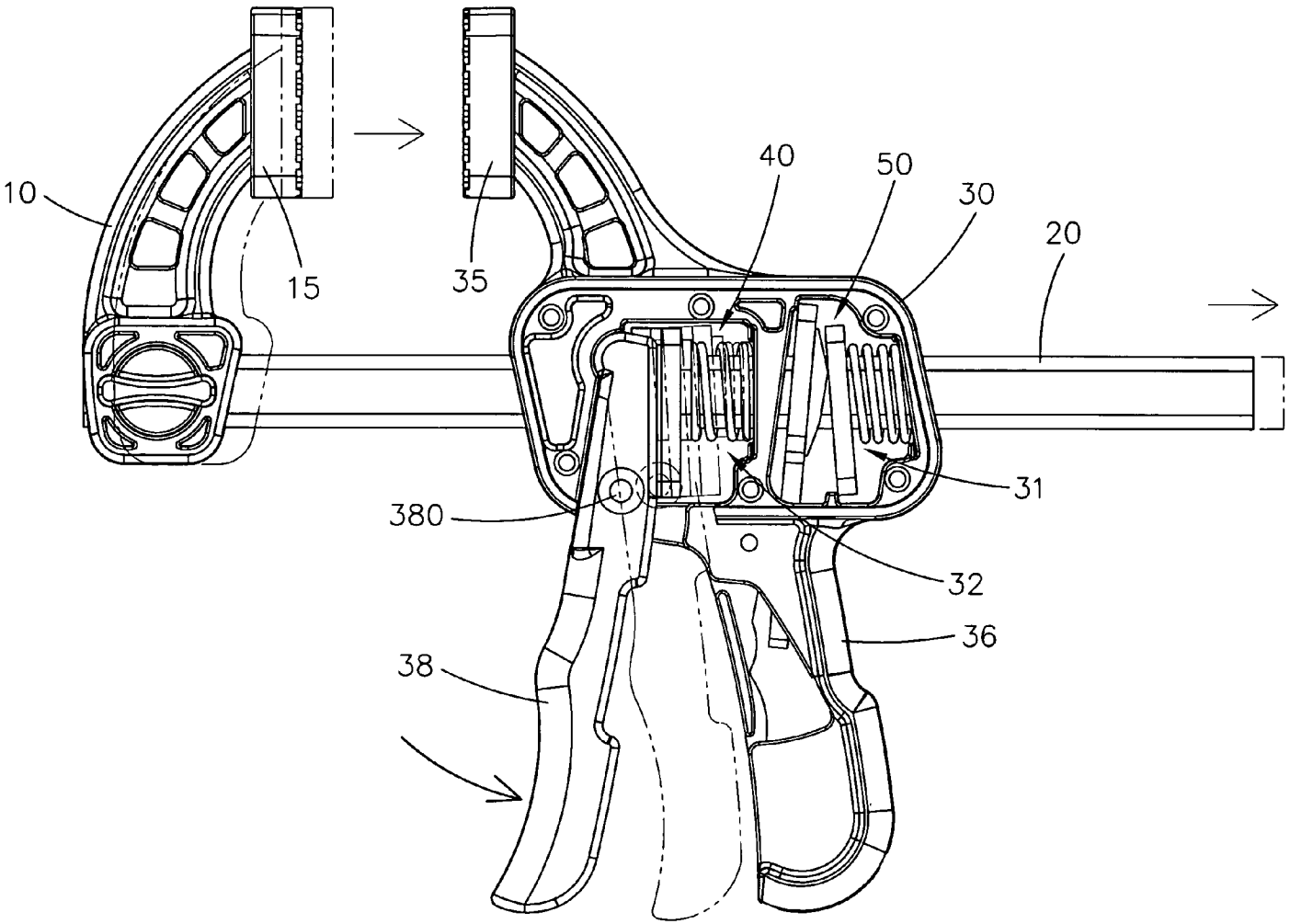
FIG. 5 is similar to FIG. 4 but shows the vise clamp for clamping.

The moving device 40 consists of a plurality grip collars 43 put around the rod 20. Two linings 41 and 42 are put against the rod 20 so that that the former form a sleeve around the latter. The grip collars 43 are put around the linings 41 and 42. The first of the grip collars 43 is put against the bar 380. A spring 45 is compressed between the last of the grip collars 43 and a rear wall of the second chamber 32. Thus, the grip collars 43 are normally perpendicular to the rod 20 (FIG. 4). As the first trigger 38 is operated, the grip collars 43 are tilted in order to grip and move the rod 20 (FIG. 5). The grip collars 43 can be returned to the normal position by means of the spring 45.

Figure 6:
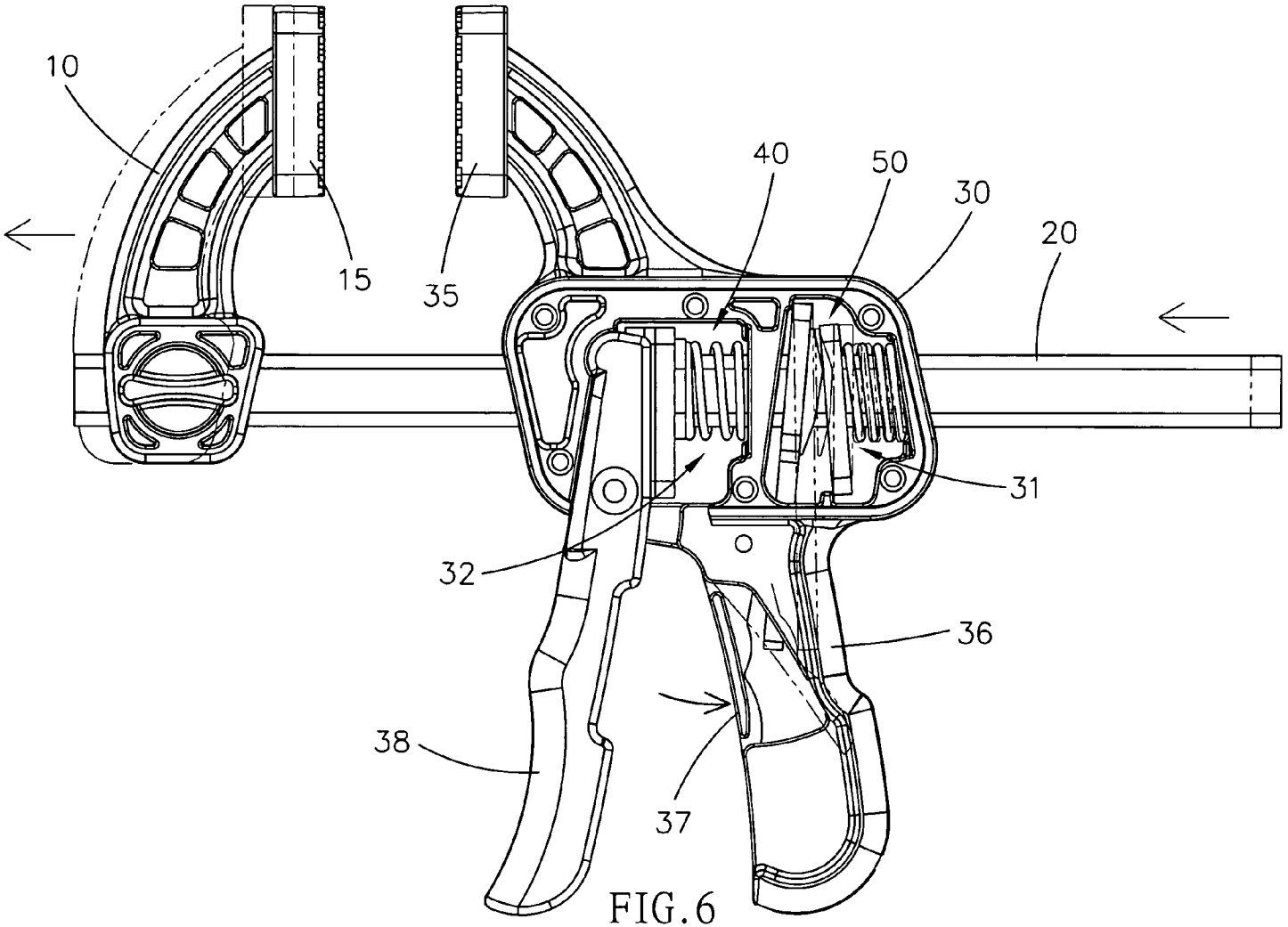
FIG. 6 is similar to FIG. 4 but shows the vise clamp for releasing.

The retaining device 50 consists of a first grip collar 51, a second grip collar 52 and a third grip collar 53 that are put around the rod 20. The lower end of the first grip collar 51 is put against the lower block 33. A spring 55 is compressed between the first grip collar 51 and a rear wall of the first chamber 31. Thus, the first grip collar 51 is normally tilted in order to grip the rod 20 (FIG. 4). The second grip collar 52 includes a hunch 520 in contact with the first grip collar 51. The upper end of the third grip collar 53 is put against the upper block 330. Thus, the third grip collar 53 is normally tilted in order to grip the rod 20. From the lower end of the third grip collar 53 is extended a lever 54 in contact with the second trigger 37. As the second trigger 37 is operated, the first grip collar 51 and third grip collar 53 are moved in order to release and allow the movement of the rod 20 (FIG. 6).

As mentioned above, according to the present invention, there is provided a vise clamp with an increased grip and stability in operation.

Referring FIGS. 4 through 6, the operation of the vise clamp according to the present invention will be described. Normally, the grip collars 43 of the moving device 40 are perpendicular to the rod 20 so that appropriate gaps exist between the linings 41 and 42 and the rod 20. The rod 20 can be moved relative to the moving device 40. An angle exists between the first grip collar 51 and the third grip collar 53 of the retaining device 50. The rod 20 cannot be moved relative to the retaining device 50. Hence, the movable jaw 10 cannot be moved relative to the stationary jaw 30.

Referring to FIG. 5, wishing to clamp a workpiece, a user holds the handle 36 with a hand and operates the first trigger 38 with a finger in order to tilt the grip collars 43 through the bar 380 installed on the first trigger 38. As tilted, the grip collars 43 grip and move the rod 20 backwards through the linings 41 and 42. Thus, the contact portion 15 of the movable jaw 10 is moved towards the contact portion of the stationary jaw 30 in order to clamp the workpiece. After the workpiece is clamped, the retaining device 50, specifically the first grip collar 51 and the second grip collar 53, grip the rod 20, thus avoiding movement of the movable jaw 10 from the stationary jaw 30. Besides, the linings 41 and 42 provide an adequate and stable contact with the rod 20. Hence, the vise clamp provides a stable operation and a large clamping force.

Referring to FIG. 6, wishing to release the workpiece, the user operates the second trigger 37. The second trigger 37 pushes the lever 54 of the third grip collar 53 so that the third grip collar 53 is perpendicular to the rod 20. Moreover, the second grip collar 52 pushes the first grip collar 51 through the hunch 520 so that the second grip collar 52 and the first grip collar 51 are perpendicular to the rod 20. Thus, the rod 20 can be moved relative to the retaining device 50. Now, the rod 20 is moved relative to the moving device 40 since the first trigger 38 is not operated. Therefore, the movable jaw 10 can be moved from the stationary jaw 30 in order to release the workpiece.

The present invention has been described through the detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A vise clamp comprising:

a stationary jaw (30);

a rod (20) inserted through the stationary jaw (30);

a movable jaw (10) secured to the rod (20);

a moving device (40) put in the stationary jaw (30), the moving device (40) comprising a plurality of grip collars (43) around the rod (20), two linings (41; 42) between the grip collars (43) and the rod (20), and a spring (45) for pushing the grip collars (43) so that the grip collars (43) are perpendicular to the rod (20) in order to release the rod (20);

a first trigger (38) connected to the stationary jaw (30) and operable to tilt the grips collars (43) relative to the rod (20);

a retaining device (50) put in the stationary jaw (30), the retaining device (50) comprising a first grip collar (51) around the rod (20), a second grip collar (52) put around the rod (20) and formed with a hunch (520) for abutment against the first grip collar (51), a third grip collar (53) around the rod (20), a spring (55) for pushing the first grip collar (51), and a lever (54) extended from the third grip collar (53), wherein the first and third grip collars (51; 53) are normally tilted relative to the rod (20) in order to grip the rod (20); and a second trigger (37) connected to the stationary jaw (30) and operable to push the third grip collar (53) through the lever (54) so that the third and first grip collars (53; 51) are perpendicular to the rod (20).

2. The vise clamp according to claim 1 wherein the stationary jaw (30) defines a first chamber (31) for containing the retaining device (50) and a second chamber (32) for containing the moving device (40).

3. The vise clamp according to claim 2 comprising a block (33) formed on the floor of the first chamber (31) for abutment against a lower end of the first grip collar (51) so that the first grip collar (51) is tilted relative to the rod (20).

4. The vise clamp according to claim 2 comprising a block (330) formed on the ceiling of the first chamber (31) for abutment against an upper end of the third grip collar (53) so that the third grip collar (53) is tilted relative to the rod (20).

5. The vise clamp according to claim 2 comprising a cover (39) for covering the first and second chambers (31; 32).

6. The vise clamp according to claim 1 comprising a bar (380) put on the first trigger (38) in order to push the moving device (40).

7. The vise clamp according to claim 1 wherein the stationary jaw (30) comprises a contact portion (35) formed thereon for contact with a workpiece, wherein the movable jaw (10) comprises a contact portion (15) formed thereon for contact with the workpiece.

8. The vise clamp according to claim 1 wherein the stationary jaw (30) comprising a handle (36) extended from the bottom thereof.

9. The vise clamp according to claim 8 wherein the second trigger (37) is connected to the handle (36).

* * * * *